US012789313B2

(12) United States Patent
Su et al.

(10) Patent No.: US 12,789,313 B2
(45) Date of Patent: Nov. 10, 2026

(54) POLISHING PAD WITH ENDPOINT DETECTION WINDOW

(71) Applicant: Rohm and Haas Electronic Materials CMP Holdings, Inc., Newark, DE (US)

(72) Inventors: Yu-Chung Su, Jhubei City (TW); Lee Melbourne Cook, Atglen, PA (US); Hyunjin Kim, Philadelphia, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 519 days.

(21) Appl. No.: 18/404,519

(22) Filed: Jan. 4, 2024

(65) Prior Publication Data

US 2024/0253177 A1 Aug. 1, 2024

Related U.S. Application Data

(63) Continuation-in-part of application No. 18/162,516, filed on Jan. 13, 2023, now abandoned.

(51) Int. Cl.

| | |
|---|---|
| ***B24B 37/20*** | (2012.01) |
| ***B24B 37/22*** | (2012.01) |
| ***B24B 37/24*** | (2012.01) |

(52) U.S. Cl.

CPC ..... *B24B 37/205* (2013.01); *B24B 37/22* (2013.01); *B24B 37/24* (2013.01)

(58) Field of Classification Search

CPC ..... B24B 37/205; B24B 37/22; B24B 37/24

See application file for complete search history.

(56) References Cited

U.S. PATENT DOCUMENTS

| | | | |
|---|---|---|---|
| 6,524,176 | B1 | 2/2003 | Cheng et al. |
| 6,716,085 | B2 | 4/2004 | Wiswesser et al. |
| 7,081,044 | B2 | 7/2006 | Ohta et al. |
| 7,195,539 | B2 | 3/2007 | Turner et al. |
| 7,264,536 | B2 | 9/2007 | Wiswesser et al. |
| 7,435,161 | B2 | 10/2008 | Prasad et al. |
| 7,621,798 | B1 | 11/2009 | Bennett et al. |

(Continued)

FOREIGN PATENT DOCUMENTS

| | | |
|---|---|---|
| JP | 5142866 | 2/2013 |
| KR | 100406730 | 11/2003 |

OTHER PUBLICATIONS

Copending U.S. Appl. No. 18/621,411.
Copending U.S. Appl. No. 18/621,430.
Copending U.S. Appl. No. 18/621,445.

*Primary Examiner* — Michael Leslie
(74) *Attorney, Agent, or Firm* — Blake T. Biederman

(57) ABSTRACT

A polishing pad for chemical mechanical polishing comprises a polishing layer having a top polishing surface, a sub-pad located opposite from the top polishing surface, the sub-pad comprising a sub-pad material and having a bottom sub-pad surface defining a bottom surface of the polishing pad, and a window for transmitting a signal wave through the polishing pad to a substrate to be polished and back through the polishing pad for endpoint detection, the window having a top window surface, a bottom window surface, and side edges, wherein the top window surface is recessed from the top polishing surface, the bottom window surface is substantially coplanar with the bottom sub-pad surface, and the side edges are in contact with the polishing material and the sub-pad material.

10 Claims, 7 Drawing Sheets

(56) References Cited

U.S. PATENT DOCUMENTS

| | | | | |
|---|---|---|---|---|
| 7,938,714 | B2 | 5/2011 | Benvegnu et al. | |
| 8,657,653 | B2 | 2/2014 | Allison et al. | |
| 9,126,304 | B2 | 9/2015 | Kimura | |
| 2008/0003923 | A1 | 1/2008 | Benvegnu et al. | |
| 2008/0207089 | A1 | 8/2008 | Lehman et al. | |
| 2010/0184357 | A1 | 7/2010 | Qian et al. | |
| 2016/0263721 | A1 | 9/2016 | So et al. | |
| 2017/0246722 | A1* | 8/2017 | Hu | B24B 37/24 |
| 2022/0226956 | A1 | 7/2022 | Guzman | |
| 2023/0009519 | A1 | 1/2023 | Wiswell et al. | |
| 2023/0009737 | A1 | 1/2023 | Wiswell et al. | |
| 2023/0158633 | A1 | 5/2023 | Heo et al. | |
| 2024/0253175 | A1* | 8/2024 | Su | B24B 37/205 |
| 2024/0253176 | A1* | 8/2024 | Su | B24B 37/013 |
| 2025/0303515 | A1* | 10/2025 | Kim | B24B 37/205 |
| 2025/0303516 | A1* | 10/2025 | Kim | B24B 37/205 |
| 2025/0303517 | A1* | 10/2025 | Kim | B24B 37/205 |

* cited by examiner

POLISHING PAD WITH ENDPOINT DETECTION WINDOW

FIELD OF THE INVENTION

The field of the invention is polishing pads used in chemical mechanical polishing.

BACKGROUND OF THE INVENTION

Chemical Mechanical Planarization (CMP) is a variation of a polishing process that is widely used to flatten, or planarize, the layers of construction of an integrated circuit or similar structure. Particularly, CMP is frequently used to produce planar uniform layers of a defined thickness in the manufacture build three-dimensional circuit structures by an additive stacking and planarizing process. CMP can remove excess deposited material on the substrate (e.g., wafer) surface to produce an extremely flat layer of a uniform thickness, with uniformity extending across the entire substrate (e.g., wafer) area. When the uniform thickness is across the entire wafer, it is known as global uniformity.

CMP utilizes a liquid, often called slurry, that can contain nano-sized particles. The slurry is fed onto the surface of a rotating multilayer polymer pad (sometimes referred to as polishing sheet), the pad being mounted on a rotating platen. The polishing pad includes a polishing layer and can include a sub-pad. Substrates (e.g., wafers) are mounted into a separate fixture, or carrier, that has a separate means of rotation, and pressed against the surface of the pad under a controlled load. This can lead to a high rate of relative motion between the substrate (e.g., wafer) and the polishing pad and a resulting high rate of shear or abrasion at both the substrate and the pad surface. The shear and the slurry particles trapped at the pad/substrate junction abrade the substrate (e.g., wafer) surface, leading to removal of material from the substrate surface. Control of removal rate and the uniformity of removal are important. Also, it is useful to use metrology to determine when the polishing has met its desired goal (e.g., film thickness, intended reveal of an underlying structure, etc.). This is referred to as endpoint detection.

Various types of film thickness metrology, together with real time control software, can be used for endpoint detection. Endpoint detection processes periodic signals, such as a collimated light wave, non-collimated light wave or an acoustic signal wave to avoid wafer yield issues from both under-polishing and over-polishing. For example, one approach for endpoint detection is an optical endpoint detection system that uses transmittance of desired wavelengths of light through the polishing pad, the light reflects from the substrate being polished, and the reflected light signal then passes back to the interferometer. This requires that at least a portion of the polishing pad be sufficiently transparent to the light source used to yield an acceptable signal to noise ratio. The metrology equipment can be located within the polishing equipment or the body of the platen that holds the pad.

For certain pad structures where optical detection is used, the pad material itself can be transparent to the desired optical wavelength and or have a design to allow effective transmittance of the signal waves. Alternatively, the pad can include alternate structures to facilitate transmittance of the waves. For example, a transparent polymer can be provided and opaque material molded around that to produce a transparent window. See e.g., U.S. Pat. No. 5,605,760. A third approach is to form a pad with an aperture into which a transparent window material is inserted and held in place with an adhesive. See, e.g., U.S. Pat. No. 5,893,796. Various versions of these pads with windows have been proposed. See e.g., U.S. Pat. Nos. 7,621,798, 8,475,228, 10,569,383, U.S. 2021/0402556, U.S. Pat. Nos. 9,475,168, 6,045,439, 6,716,085, and 8,475,228.

Transmittance of a signal wave through a boundary between a gap (e.g., air) and a surface of the window can lead to refraction or reflection of the signal wave that can create noise or reduce the signal thereby lessening the effectiveness of using the signal wave for endpoint detection.

In addition, since a window is typically formed of a material distinct from the polishing layer, other problems can arise. Particularly, since the modulus and stiffness of the solid polymer window material typically is higher than that of the surrounding composite pad, differential compression during the polishing process leads to deformation of the vicinity of the window. Differences in the coefficient of thermal expansion (CTE) and thermal conductivity (K) between the polishing material and the window can further exacerbate problems. Since the upper surfaces of the pad and window are frictionally heated during CMP, differences in CTE and K produce an additional transient stress and deformation. This can cause the window area to protrude above the upper surface of the pad polishing area during use. The protrusion of the window can cause scratching of the substrate being polished. In addition, a gap in the peripheral area around the protruding area acts as a trap for slurry, conditioning debris, and other foreign contaminates that can also lead to increased scratch defect rates. Furthermore, since the pad is conditioned during use, the conditioning wear rate is significantly higher in the raised area because of the increase in contact pressure. This differential thinning of the window can disturb the optical signal and, eventually, can lead to a break-through in the window, that is a catastrophic failure giving reduced pad lifetime.

Thus, a need remains for an improved polishing pad with window region for use in end-point detection.

SUMMARY OF THE INVENTION

Disclosed herein is a polishing pad for chemical mechanical polishing comprising a polishing layer having a top polishing surface and comprising a polishing material, a sub-pad layer comprising a sub-pad material wherein the sub-pad layer is located opposite from the top polishing surface, the sub-pad layer having a bottom sub-pad surface defining a bottom surface of the pad, and a window extending through the polishing pad for transmitting a signal wave through the polishing pad, wherein the window has a top portion that forms a seal with the polishing layer, the top portion comprising a first window material, and a bottom portion that extends from an interface with the top portion of the window to the bottom surface of the pad and that comprises an elastomeric material wherein there is a gap between side edges of the bottom portion and the sub-pad material.

BRIEF DESCRIPTION OF THE DRAWINGS

Referring now to the figures, that are exemplary embodiments, and wherein the like elements are numbered alike.

FIG. 5 is a cross-sectional view of a portion of one example of polishing pad as disclosed herein.

DETAILED DESCRIPTION OF THE INVENTION

Figure 1A:
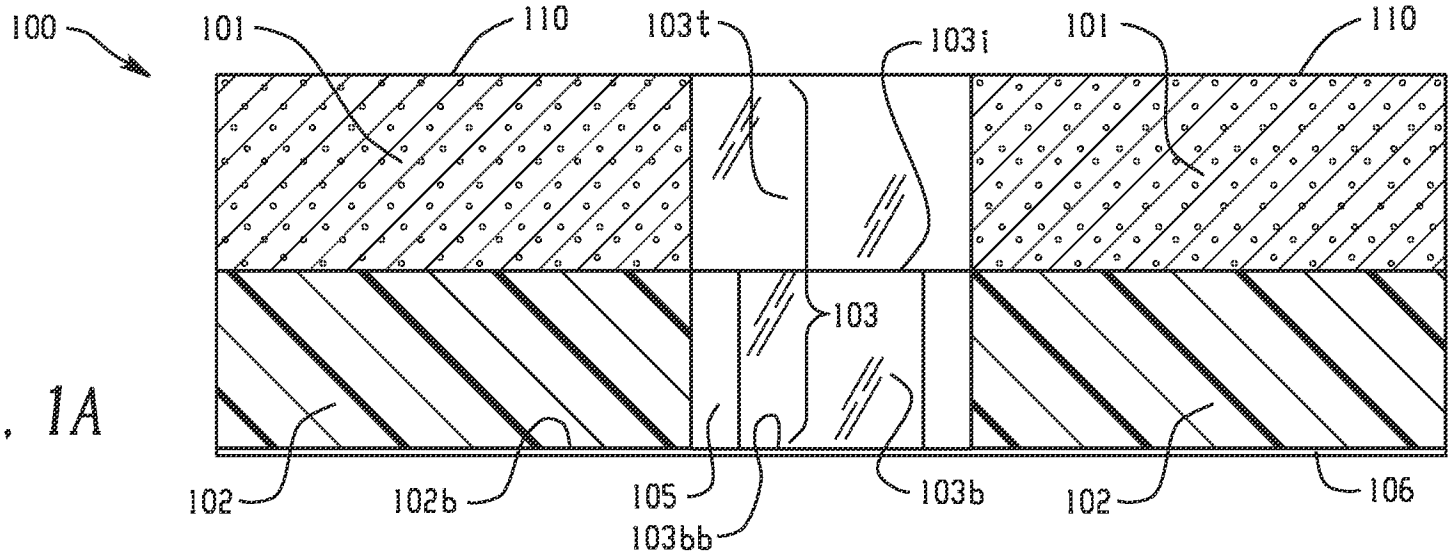
FIG. 1A is a cross-sectional view of a portion of one example of polishing pad as disclosed herein not under deformation force.

Disclosed herein is a polishing pad useful in chemical mechanical polishing. The polishing pad includes a window that extends to the bottom of the pad, thus avoiding refraction and reflection of the signal waves at a solid/gas interface between the bottom of the window and a region above the platen. At the same time, the polishing pad design enables for compressibility of the pad in the window region to more closely correspond to compressibility in the rest of the pad. This design reduces stresses and avoids or eliminates bulging of the window above the top polishing surface, thus, reducing defects during polishing.

Particularly, the polishing pad comprises a polishing layer, a sub-pad, and a window. The polishing layer has a top polishing surface and a thickness. The polishing layer comprises a polishing material. The top surface of the window can be recessed from the top polishing surface. Alternatively, the top surface of the window can be coplanar with the top polishing surface. The sub-pad comprises a sub-pad material and is located opposite the top polishing surface. The window material is transmissive of a signal wave. The signal wave can be, for example, light wave(s) (e.g., columnated light or non-columnated light) or acoustic wave(s).

The window extends through the pad. The window comprises two portions. A top portion comprises a first window material. The top portion can form a seal with the polishing layer. The first window material can be a material conventionally used in such windows in polishing pads. This is desirable as the conditioning rates of such conventionally used materials may have already been designed to work well with that of the surrounding polishing material. The top portion can be relatively rigid (as compared to the elastomeric bottom portion of the window) such that the top portion in the plane of or parallel to the top polish surface does not substantially deform during polishing.

The top portion of the window can comprise as the first window material a polymer or polymer blends. For optical detection systems the first window material should have sufficient transmission at the wavelengths of light used by the optical metrology. It can be helpful if that window material has a hardness or thermal expansion coefficient similar to that of the material used in the polishing layer. Examples of window materials include polyurethanes, acrylic polymers, cyclic olefin co-polymers (e.g., TOPAS 8007, etc.).

The window is advantageously made from an aliphatic polyisocyanate-containing material ("prepolymer"). The prepolymer is a reaction product of an aliphatic polyisocyanate (e.g., diisocyanate) and a hydroxyl-containing material. The prepolymer is then cured with a curing agent. Preferred aliphatic polyisocyanates include, but are not limited to, methlene bis 4,4' cyclohexylisocyanate, cyclohexyl diisocyanate, isophorone diisocyanate, hexamethylene diisocyanate, propylene-1,2-diisocyanate, tetramethylene-1,4-diisocyanate, 1,6-hexamethylene-diisocyanate, dodecane-1,12-diisocyanate, cyclobutane-1,3-diisocyanate, cyclohexane-1,3-diisocyanate, cyclohexane-1,4-diisocyanate, 1-isocyanato-3,3,5-trimethyl-5-isocyanatomethylcyclohexane, methyl cyclohexylene diisocyanate, triisocyanate of hexamethylene diisocyanate, triisocyanate of 2,4,4-trimethyl-1,6-hexane diisocyanate, uretdione of hexamethylene diisocyanate, ethylene diisocyanate, 2,2,4-trimethylhexamethylene diisocyanate, 2,4,4-trimethylhexamethylene diisocyanate, dicyclohexylmethane diisocyanate, and mixtures thereof. The preferred aliphatic polyisocyanate has less than 10 wt. % unreacted isocyanate groups.

Advantageously, the curing agent is a polydiamine. Preferred polydiamines include, but are not limited to, diethyl toluene diamine ("DETDA"), 3,5-dimethylthio-2,4-toluenediamine and isomers thereof, 3,5-diethyltoluene-2,4-diamine and isomers thereof, such as 3,5-diethyltoluene-2,6-diamine, 4,4'-bis-(sec-butylamino)-diphenylmethane, 1,4-bis-(sec-butylamino)-benzene, 4,4'-methylene-bis-(2-chloroaniline), 4,4'-methylene-bis-(3-chloro-2,6-diethylaniline) ("MCDEA"), polytetramethyleneoxide-di-p-aminobenzoate, N,N'-dialkyldiamino diphenyl methane, p,p'-methylene dianiline ("MDA"), m-phenylenediamine ("MPDA"), methylene-bis 2-chloroaniline ("MBOCA"), 4,4'-methylene-bis-(2-chloroaniline) ("MOCA"), 4,4'-methylene-bis-(2,6-diethylaniline) ("MDEA"), 4,4'-methylene-bis-(2,3-dichloroaniline) ("MDCA"), 4,4'-diamino-3,3'-diethyl-5,5'-dimethyl diphenylmethane, 2,2',3,3'-tetrachloro diamino diphenylmethane, trimethylene glycol di-p-aminobenzoate, and mixtures thereof. Preferably, the curing agent of the present invention includes 3,5-dimethylthio-2,4-toluenediamine and isomers thereof. Suitable polyamine curatives include both primary and secondary amines.

In addition, other curatives such as, a diol, triol, tetraol, or hydroxy-terminated curative may be added to the aforementioned polyurethane composition. Suitable diol, triol, and tetraol groups include ethylene glycol, diethylene glycol, polyethylene glycol, propylene glycol, polypropylene glycol, lower molecular weight polytetramethylene ether glycol, 1,3-bis(2-hydroxyethoxy) benzene, 1,3-bis-[2-(2-hydroxyethoxy)ethoxy]benzene, 1,3-bis-{2-[2-(2-hydroxyethoxy) ethoxy]ethoxy}benzene, 1,4-butanediol, 1,5-pentanediol, 1,6-hexanediol, resorcinol-di-(beta-hydroxyethyl) ether, hydroquinone-di-(beta-hydroxyethyl) ether, and mixtures thereof. Preferred hydroxy-terminated curatives include 1,3-bis(2-hydroxyethoxy) benzene, 1,3-bis-[2-(2-hydroxyethoxy)ethoxy]benzene, 1,3-bis-{2-[2-(2-hydroxyethoxy)ethoxy] ethoxy}benzene, 1,4-butanediol, and mixtures thereof. Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

The bottom portion comprises an elastomeric material. As used herein, "elastomeric material" means one that deforms when under force but which returns substantially to the original its original form when the force is removed. There is a gap between at least a portion of the elastomeric material and at least a portion of the sub-pad material. The gap allows the elastomeric material of the bottom portion of the window to deform into the gap when the pad is under downforce (but returns substantially to its original shape when the downforce is removed). Particularly, the thickness of the bottom portion will be reduced under the down force but the perimeter may expand in a direction perpendicular to the down force. This compression reduces deformation forces in the polishing layer, particularly at the polishing surface. The compressibility of the bottom portion can be selected to substantially match that of the surrounding sub-pad material, the surrounding polishing material or both. Because the window extends to the bottom edge of the pad reflection and refraction of the signal wave at a solid/gas or solid/vacuum interface is avoided.

The elastomeric material has an elastic modulus is lower than that of the first window material. Desirably the elastomeric material can have a similar refractive index and optical transmittance to the upper window layer. A wide variety of transparent elastomers can be used, such as, for example, polyurethanes, polyolefins, polyamides, poly acrylates, styrenic block copolymers, and silicone elastomers. A preferred material family are silicone elastomers. An elastomeric material that can be easily cast or molded into appropriate shapes is desirable.

CMP pads are produced with a variety of top layer and bottom layer thicknesses and modulus. For example, CMP pads can have a polishing layer with a tensile storage modulus of 300 to 400 MPa, while the sub pad tensile storage modulus can be 5 to 30 MPa. The overall composite compressibility is highly affected by the relative layer thickness. The design of pads of the present invention allows simple methods for selecting an appropriate lower window layer material. For example, standard compressibility testing methods can be used on test samples of the pad stack and the window stack to allow rapid compressibility matching prior to any pad fabrication.

In one example, a top surface of the window (top surface of the top portion) can be recessed below the top polishing surface. Having a top window surface recessed below the top polishing avoids protrusion of the window material above the top polishing surface that can lead to defects or scratching. For example, a recessed top window surface avoids or prevents direct pressure transmission between the window between the substrate (e.g., silicon wafer). Furthermore, such a recess can avoid problems created by differences in conditioning wear rate between the polishing layer material and the first window material. The stress relief can be further enhanced by including a peripheral portion of polishing material around the window that peripheral portion is also recessed below the top polishing surface. The recessed region can provide enhanced flexibility that can be particularly helpful in alleviating stresses created by differences in thermal expansion effects between the polishing layer and the top portion of the window.

Figure 1B:
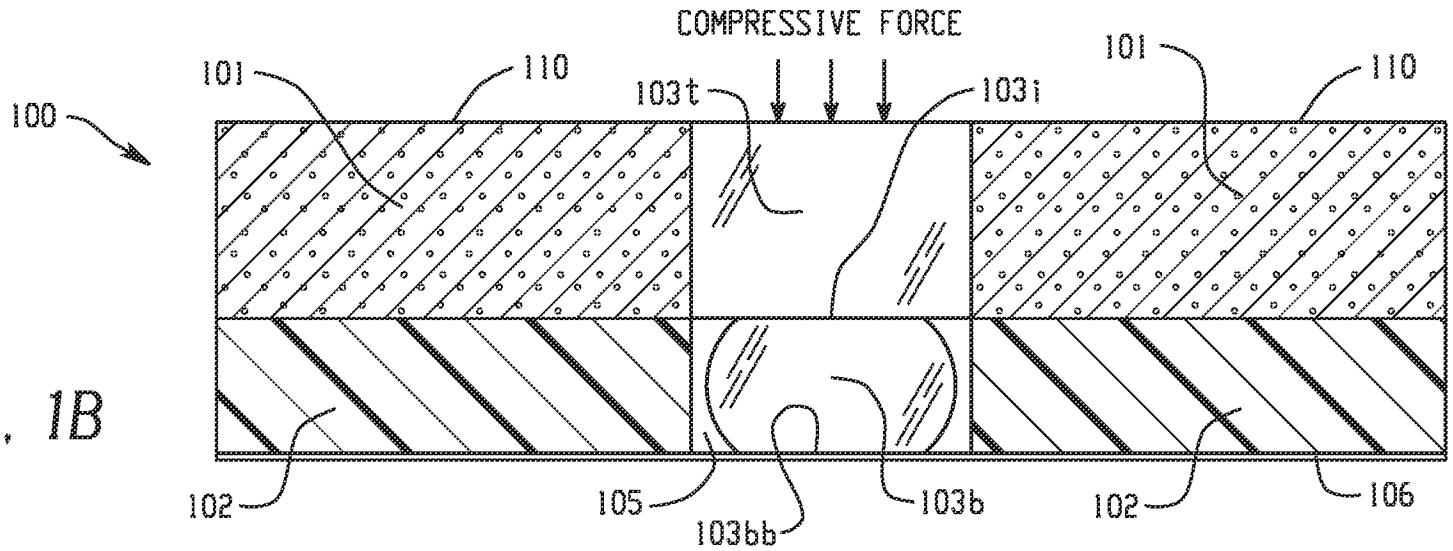
FIG. 1B is a cross-section view of the same exemplary polishing pad as in FIG. 1A under deformation force.
Figure 2A:
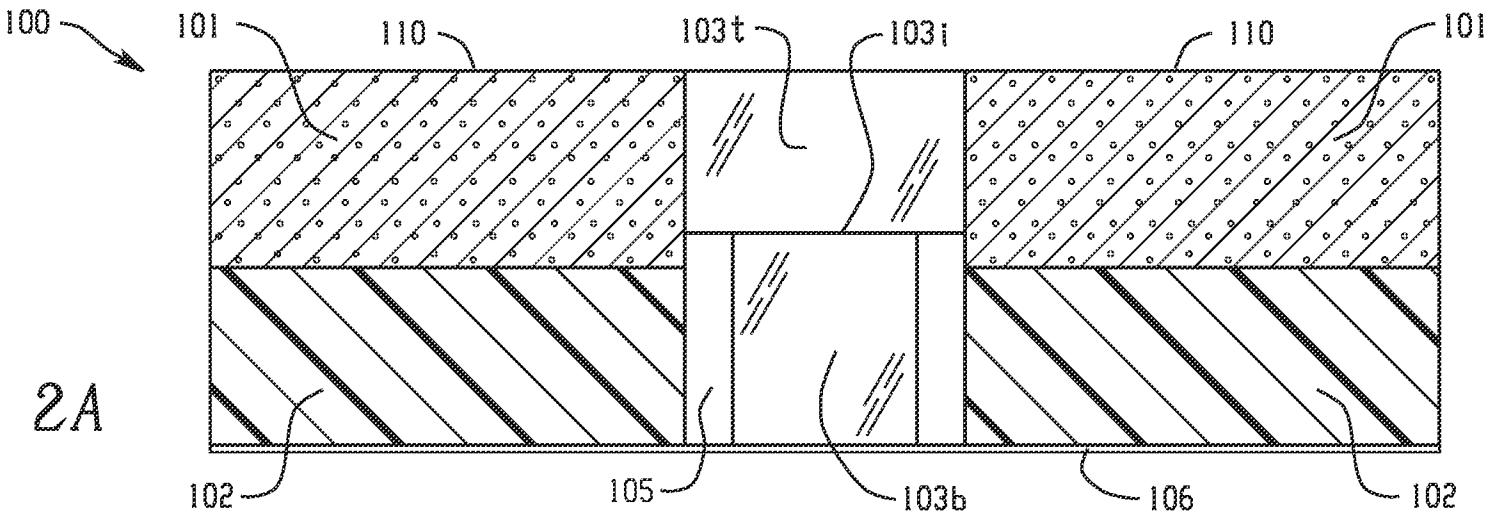
FIG. 2*a* is a cross-sectional view of a portion of one example of polishing pad as disclosed herein not under deformation force.
Figure 2B:
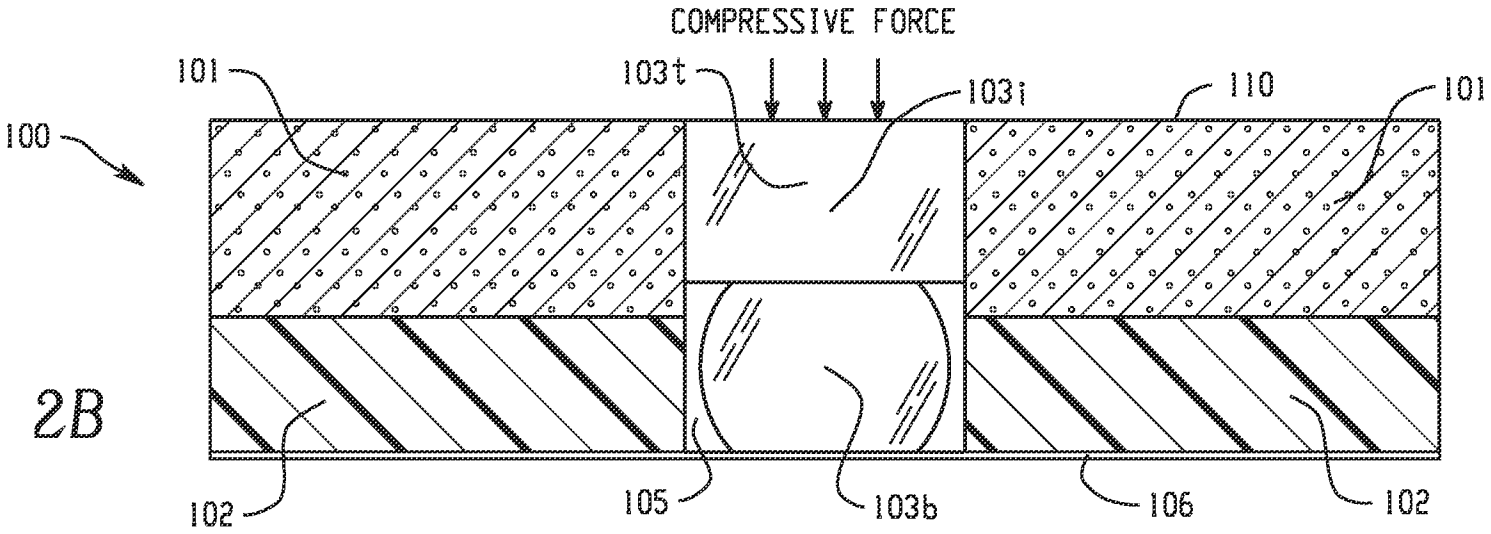
FIG. 2B is a cross-section view of the same exemplary polishing pad as in FIG. 2A under deformation force.
Figure 3:
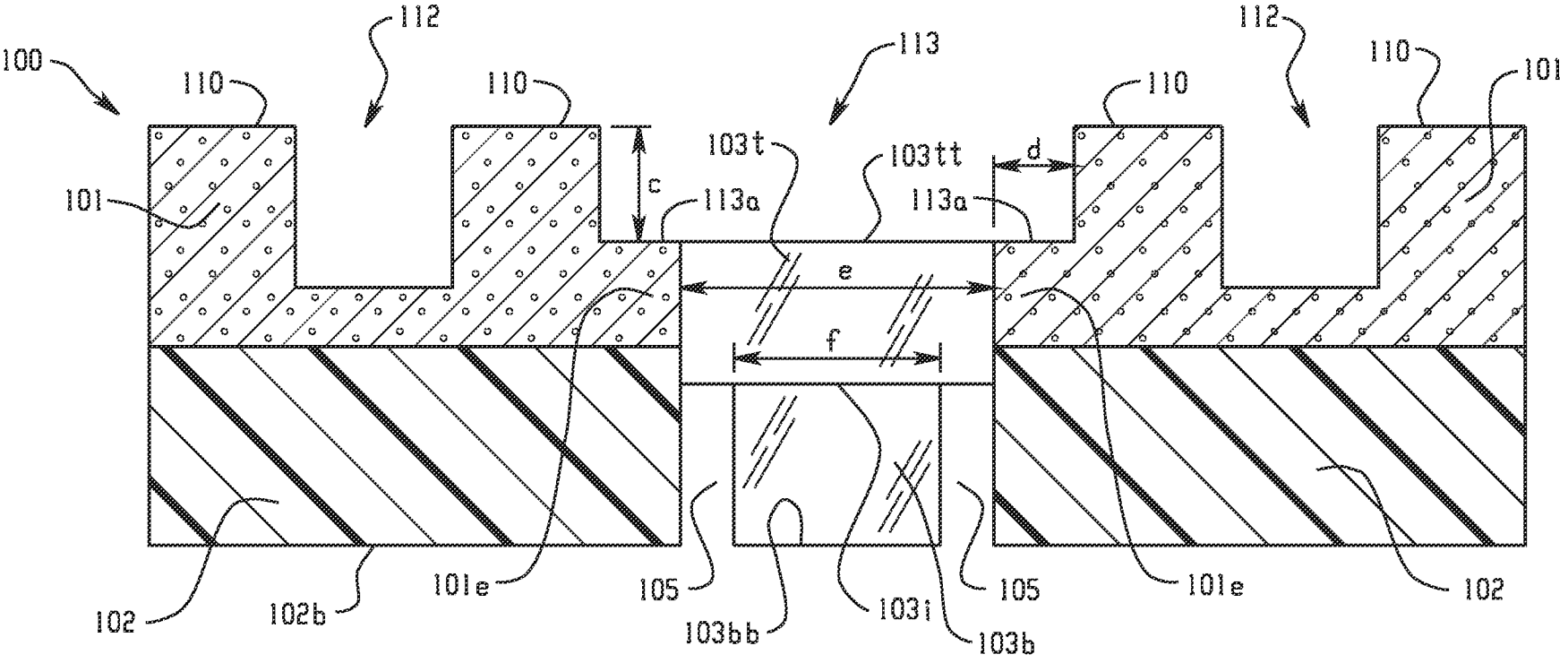
FIG. 3 is a cross-sectional view of a portion of one example of polishing pad as disclosed herein.

FIGS. 1A and 1B, 2A and 2B, and 3 show cross-sections of three examples of a portion of a polishing pad 100 as disclosed herein. FIGS. 1A, 2A, and 3 shown the exemplary pad in an undeformed state. FIGS. 1B and 2B shown the exemplary pad of FIGS. 1A and 2A, respectively, under downforce as would occur during use in polishing.

The polishing pad 100 has a polishing layer 101 and a top polishing surface 110. The polishing layer 101 comprises a polishing material. FIG. 3 shows show optional macrotexture 112 on the polishing layer 101. The macrotexture can be grooves, protrusions, or raised features to enhance polishing and management of slurry fluid and removed materials.

The polishing pad 100 includes a sub-pad 102 opposite the top polishing surface 110. The sub-pad has a bottom surface 102*b*.

A window 103 extends through the pad. The window comprises a top portion 103*t* and a bottom portion 103*b*. The top portion 103*t* forms a seal with the polishing layer 101. The bottom portion 103*b*, extends from an interface 103*i* with the top portion to a bottom edge 103*bb* that is coplanar with the bottom edge 102*b* of the sub-pad 102. A gap 105 exists between the bottom portion 103*t* and the sub-pad material 102. The top portion 103*t* is joined to the bottom portion 103*b* at the interface 103*i*. As shown in FIG. 1A, 1B the interface 103*i* is coplanar with a bottom edge of the polishing layer 101. However, the interface could be located higher or lower than the bottom edge of the polishing layer 101. For example, as shown in FIG. 2A the interface 103*i* is located above the lower edge of the polishing layer, such that the bottom portion 103*b* of the window and the gap 105 extend into the thickness of the polishing layer. As another example, in FIG. 3, the interface 103*i*, is located below the lower edge of the polishing layer 101 such that the top portion 103*t* of the window extends into the thickness of the sub-pad 102.

When under downforce used during polishing, the pad 100 compresses. As shown in FIGS. 1B and 2B, shown when under that force the elastomeric material of the bottom portion 103*b* of the window compresses vertically but expands laterally into the gap 105 thereby relieving or reducing force that would otherwise create stresses in the polishing layer 101 and at the interface of the polishing layer 101 and the top portion 103*t* of the window. Upon removal of the force, the pad returns to the structures shown in FIGS. 1A and 2A, respectively.

Optionally, the pad 100 can include a pressure sensitive adhesive 106 extending on the bottom of the sub-pad 102, the bottom of the bottom portion 103*b* of the window, or both to be used to stick the pad to the platen when in use. The use of such a pressure sensitive adhesive at the bottom of the bottom portion 103*b* can be useful in ensuring no air gap between the platen and the region providing the signal wave and the window.

Figure 4:
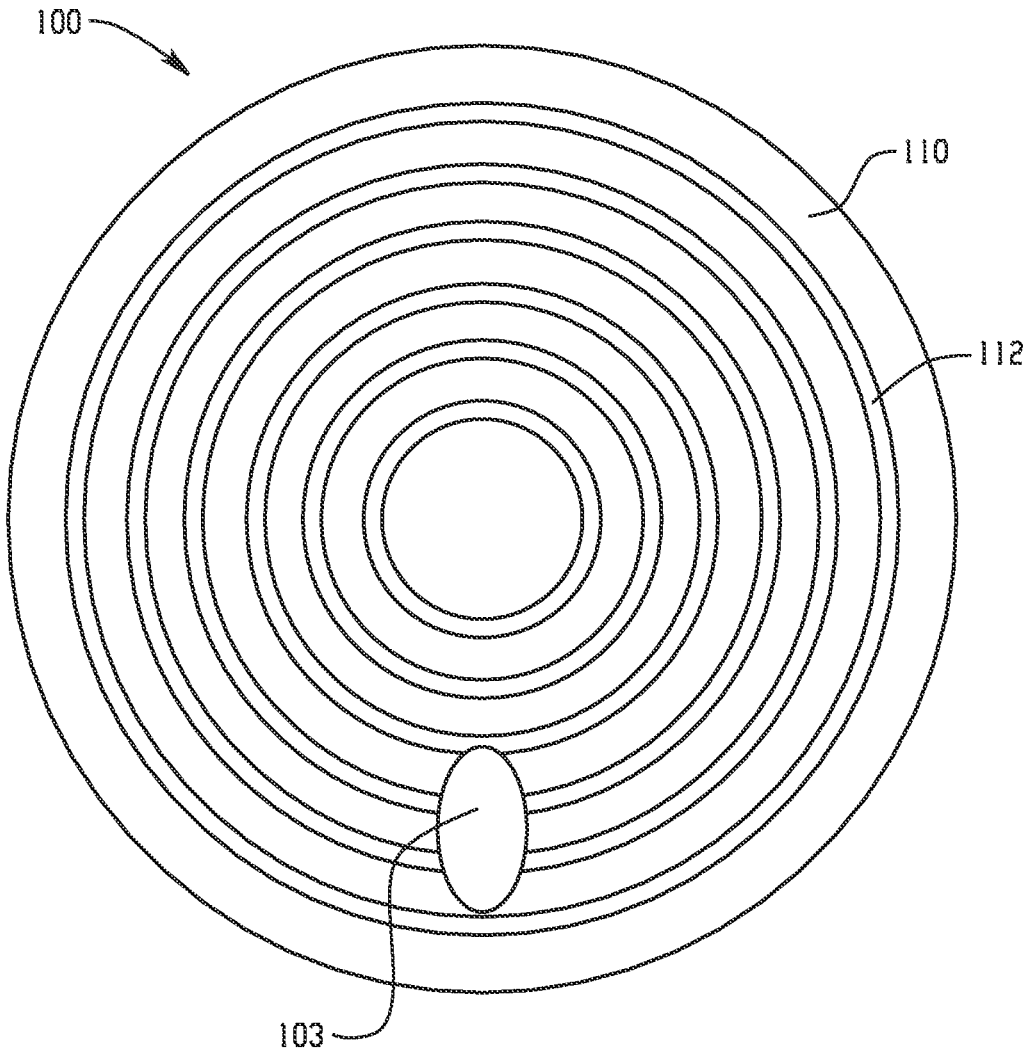
FIG. 4 is a top-down view of the upper surface of an example of the inventive pad wherein the window is oval in shape.

FIG. 4 shows a top view of an example of the polishing pad 100 as disclosed herein where 110 is the top polishing layer, 112 are optional grooves, and 103 is an oval window. Other shapes such as squares, circles, other polygons (not shown) could be used as well. Furthermore, the top polishing layer can optionally contain multiple windows (not shown), such as three or more equidistantly spaced windows. Multiple equidistant windows increase the signal frequency.

FIG. 3 shows one exemplary embodiment where a top surface 103*tt* of the window 103 can be recessed by a distance, c, from the polishing surface 110. Optionally, a ledge 101*e*, having, for example, a width, d, can be formed adjacent the recessed top portion 103*t*. The recess of the window region can extend pad lifetime. The depth of the window region recess (e.g., 113) can be adjusted to accommodate the characteristics of the materials used in the pad (e.g., the polishing material, the window material) to provide desired flexibility without undue, harmful deformation during use. Having the window extend substantially to the bottom of the sub-pad avoids additional interfaces that can disrupt the transmission of a signal wave through the pad toward the substrate to be polished. For example, a window with a bottom surface recessed above the bottom of the sub-pad can create a reflective surface that can create noise and interference with the wave transmission. Note that, since during use of the pad, a slurry is present in the recess 113, the disruption of the wave signals in that region is reduced. Particularly, with an optical system a semi-transparent slurry can be used.

Figure 6:
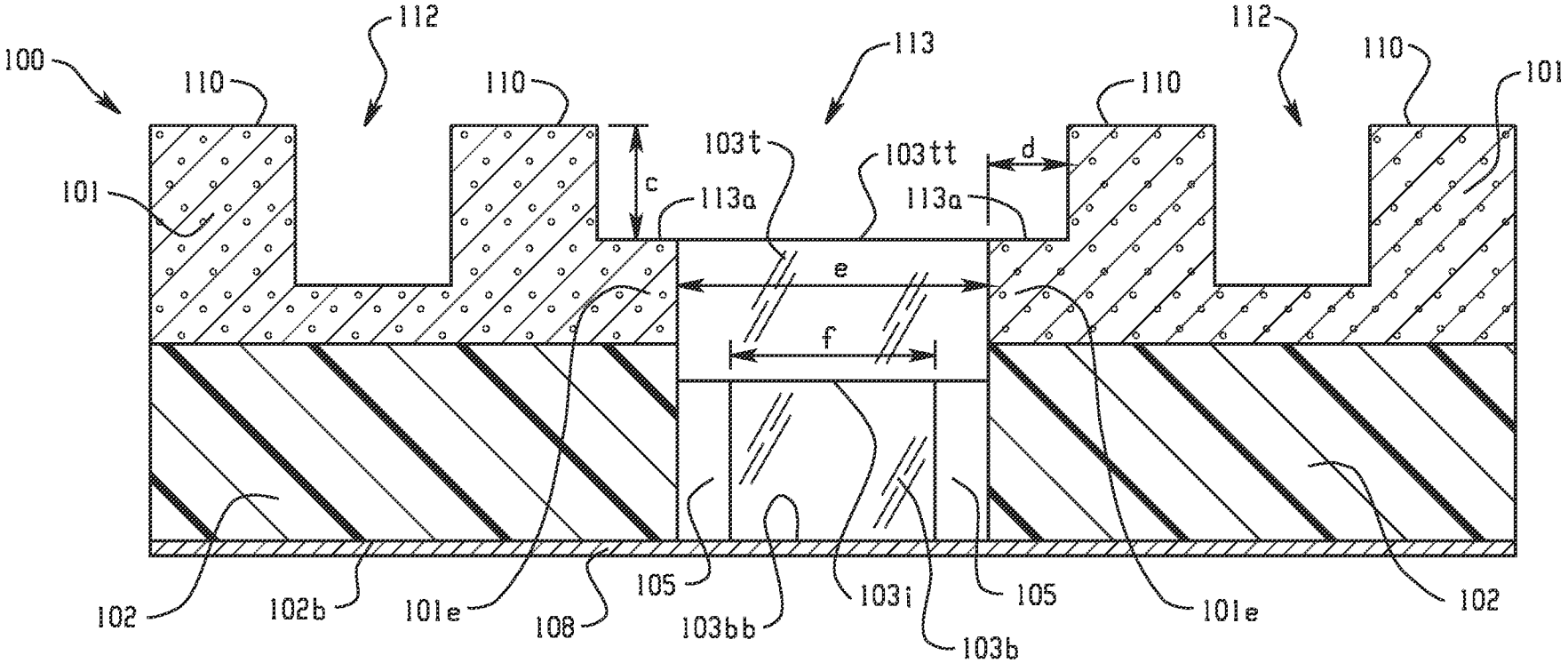
FIG. 6 is a cross-sectional view of a portion of one example of polishing pad as disclosed herein.
Figure 6:
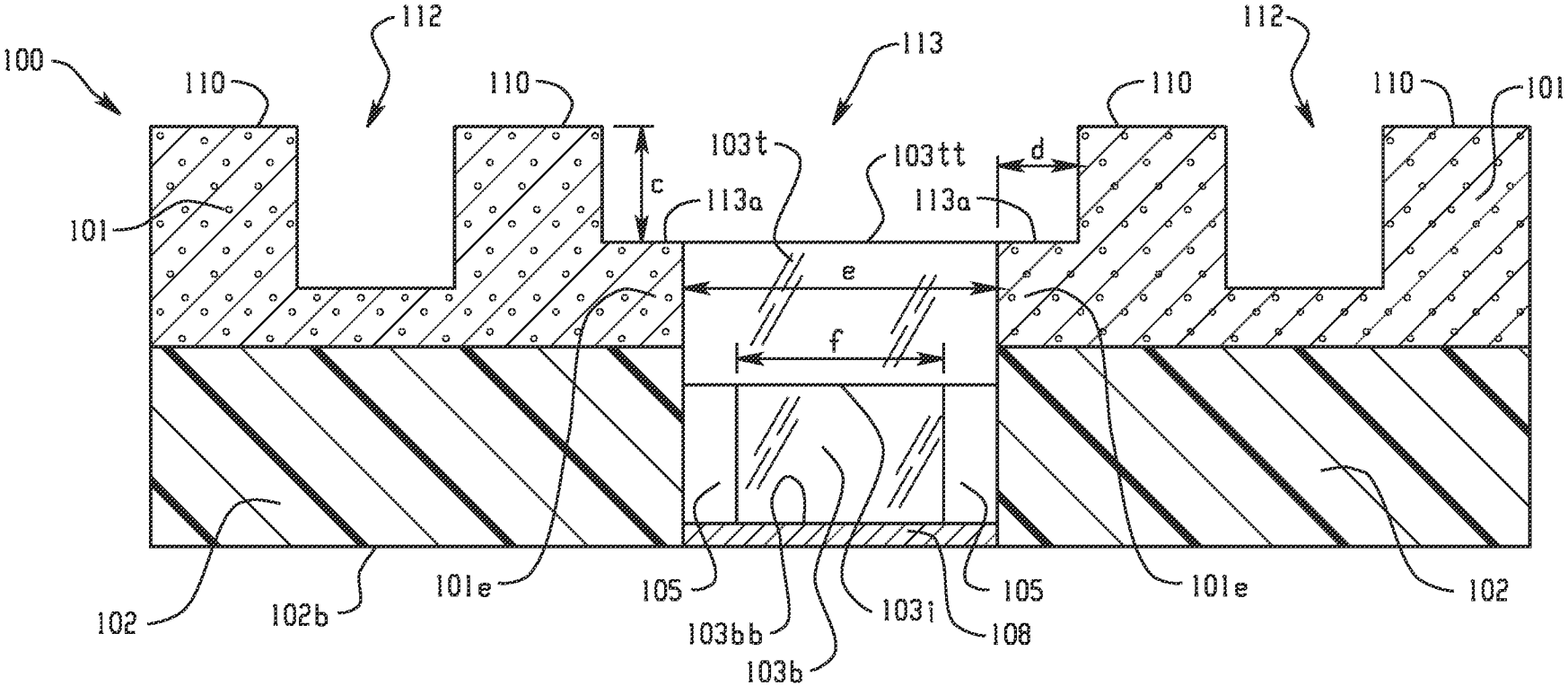
Figure 7:
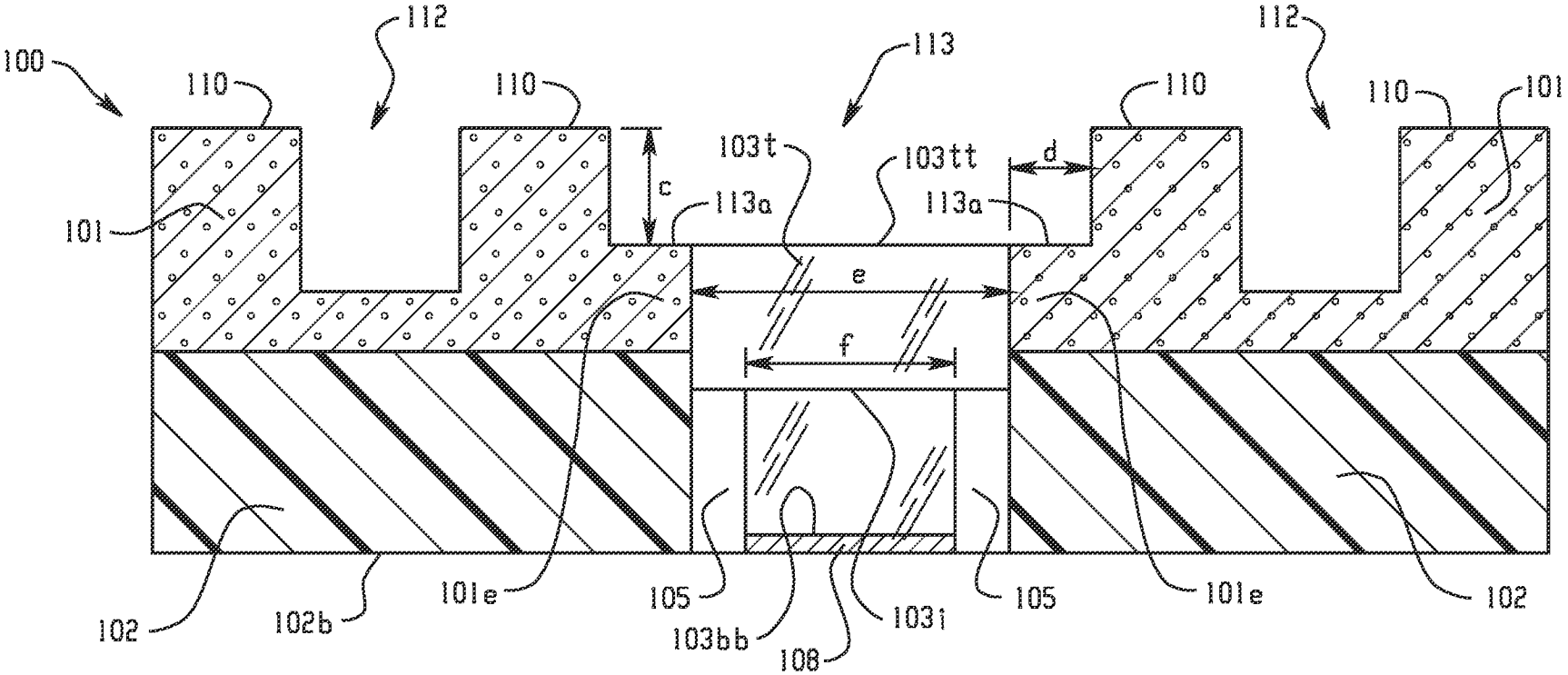
FIG. 7 is a cross-sectional view of a portion of one example of polishing pad as disclosed herein.

In another exemplary embodiment, as show in FIGS. 5, 6, and 7, the pad 100 can include an encapsulating layer 108. The encapsulating layer 108 can be a non-adhesive film. The encapsulating layer can comprise a polymer film, such as for example a polyester film.

The encapsulating layer 108 can have a layer of adhesive (not shown) on the exterior surface to facilitate adhesion of the pad to the platen. The encapsulating layer 108 can provide one or more of the following benefits: facilitate insertion of the window 103 into the pad with proper alignment; provide an even surface on the bottom of the pad; prevent any adhesive between the side edges of the window 103 and the polishing layer 101, the sub-pad 102, or both, from leaking out; assist in holding the window 103 in place; prevent any leakage of slurry to the bottom side of the polishing pad 100. In another alternative, an encapsulating layer 108 could also be added to the polishing pad 100 as shown in FIG. 1 or 2.

As shown in FIG. 5, the encapsulating layer 108 can be in contact with a bottom surface 103*bb* of the bottom portion 103*b* of the window and also the bottom surface 102*b* of the sub-pad. As shown in FIG. 6, the encapsulating layer 108 can be in contact with a bottom surface 103*bb* of the bottom portion 103*b* of the window 103 and can extend to contact the interior edges of the sub-pad 102. In this instance the bottom of the encapsulating layer 108 can be co-planar with the bottom surface 102*b* of the sub-pad. In another alternative, as shown if FIG. 7, the encapsulating layer 108 can be located only at the bottom surface 103*bb* of the bottom portion 103*b* of the window. In this instance the bottom of the encapsulating layer 108 can be co-planar with the bottom surface 102*b* of the sub-pad.

The encapsulating layer 108 or a portion of the encapsulating layer 108 underlying a portion of the window 103 can be transparent to light if light is used for end-point detection. The encapsulating layer 108 can be opaque, such as when acoustic signal waves are used for end-point detection.

In exemplary embodiments with a recessed window, the recess depth, c, can be, for example, greater than 0.1, greater than 0.2, or at least 0.3 millimeters (mm) up to 1.1, up to 1, up to 0.8, up to 0.6 mm, or up to 0.4 mm. Having a thinner polishing material in the peripheral portion of the polishing layer relative to overall polishing layer thickness can enable flexibility during use. Similarly, the width of the peripheral portion can be adjusted to provide the desired mechanical response for the pad materials and design. The width, d, of the peripheral region can be, for example, at least 0.05, at least 0.1, at least 0.2, or at least 0.3 millimeters (mm) up to 1.1, up to 1, up to 0.8, up to 0.6 mm, or up to 0.4 mm.

The top portion 103*t* of the window can have a major dimension, e, in a direction parallel to the top polishing surface 110 can be dimensions that are commonly used for windows in CMP pads. For example, the dimensions of the window in a direction parallel to the top polishing surface 100 about 6 toto 20 mm.

The bottom portion 103*b* can have a dimension, f, parallel to dimension, e, which is smaller than e to provide the gap 105. For example, dimension f can be about 5 to 18 mm. The bottom portion 103*b* can have dimensions in a plane parallel to the top polishing surface of approximately the size of the platen detector window dimensions, which can be for example 8 to 18 mm. The gap 105 surrounding the bottom portion can about 2 to 10%, 3 to 8%, or 4 to 6% of the dimensions (e.g., dimension, f) of the bottom portion 103*b* in a direction parallel to the top polishing surface 110. For example, the gap can be from 0.1, from 0.2, from 0.3, from 0.4 or from 0.5 mm up to 2, up to 1.8, up to 1.6, up to 1.4 up to 1.2 or up to 1 mm.

The overall thickness of the polishing pad (e.g., polishing layer plus sub-pad) is preferably no greater than 4 mm. For example, the overall thickness of the polishing pad can be from 1 up to 4 mm, from 1.5 up to 4 mm, from 1.7 up to 3.5 mm, or from 2 up to 3 mm. The polishing layer can have a thickness of from 0.5 up to 3, from 0.7 up to 2.5, from 1.2 up to 2.2, or from 1 to 2 mm. The sub-pad can have a thickness of from 0.5 up to 3, from 0.7 up to 2.5, from 1 to 2 mm. The thickness of the top portion of the window can have a thickness of, for example, from 0.3 up to 3.2, from 0.4 up to 2.7, from 0.8 up to 2.2, or 1 to 1 mm, while the thickness of the bottom portion from a window can be from 0.3 up to 3.2, from 0.4 up to 2.7, from 0.8 up to 2.2, or 1 to 1 mm, provided that the overall thickness of the window does not exceed the overall thickness of the pad.

The polishing material of the polishing layer 101 can comprise a polymer. The polishing material can be opaque at the thickness of the polishing layer 101. Pores can be provided, for example, by addition of hollow flexible polymer elements (e.g., hollow microspheres), blowing agents, frothing or supercritical carbon dioxide. Examples of polymeric materials for the polishing layer include polyurethanes, polycarbonates, polysulfones, nylons, polyethers, polyesters, polystyrenes, acrylic polymers, polymethyl methacrylates, polyvinylchlorides, polyvinyl fluorides, polyethylenes, polypropylenes, polybutadienes, polyethylene imines, polyether sulfones, polyamides, polyether imides, polyketones, epoxy resins, silicones, copolymers thereof (such as, polyether-polyester copolymers), and combinations or blends thereof. The polishing layer can comprise a polymer that is a polyurethane formed by reaction of one or more polyfunctional isocyanates and one or more polyols. For example, a polyisocyanate terminated urethane prepolymer can be used. The polyfunctional isocyanate used in the formation of the polishing layer of the chemical mechanical polishing pad of the present invention can be selected from the group consisting of an aliphatic polyfunctional isocyanate, an aromatic polyfunctional isocyanate and a mixture thereof. For example, the polyfunctional isocyanate used in the formation of the polishing layer of the chemical mechanical polishing pad of the present invention can be a diisocyanate selected from the group consisting of 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and, mixtures thereof. The polyfunctional isocyanate can be an isocyanate terminated urethane prepolymer formed by the reaction of a diisocyanate with a prepolymer polyol. The isocyanate-terminated urethane prepolymer can have 2 to 12 wt %, 2 to 10 wt %, 4 to 8 wt % or 5 to 7 wt % unreacted isocyanate (NCO) groups. The prepolymer polyol used to form the polyfunctional isocyanate terminated urethane prepolymer can be selected from the group consisting of diols, polyols, polyol diols, copolymers thereof and mixtures thereof. For example, the prepolymer polyol can be selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof; and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. For example, the prepolymer polyol can be selected from the group consisting of polytetramethylene ether glycol (PTMEG); ester based polyols (such as ethylene adipates, butylene adipates); polypropylene ether glycols (PPG); polycaprolactone polyols; copolymers thereof; and mixtures thereof. For example, the prepolymer polyol can be selected from the group consisting of PTMEG and PPG. When the prepolymer polyol is PTMEG, the isocyanate terminated urethane prepolymer can have an unreacted isocyanate (NCO) concentration of 2 to 10 wt % (more preferably of 4 to 8 wt %; most preferably 6 to 7 wt %). Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF). When the prepolymer polyol is PPG, the isocyanate terminated urethane prepolymer can have an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT-80A, PPT-90A, PPT-95A, PPT-65D, PPT-75D); Adiprene® prepolymers (available from Chemtura, such as, LFG 963A, LFG 964A, LFG 740D); and Andur® prepolymers (available from Anderson Development Company, such as, 8000APLF, 9500APLF, 6500DPLF, 7501DPLF). The isocyanate terminated urethane prepolymer can be a low free isocyanate terminated urethane prepolymer having less than 0.1 wt % free toluene diisocyanate (TDI) monomer content. Non-TDI based isocyanate terminated urethane prepolymers can also be used. For example, isocyanate terminated urethane prepolymers include those formed by the reaction of 4,4'-diphenylmethane diisocyanate (MDI) and polyols such as polytetramethylene glycol (PTMEG) with optional diols such as 1,4-butanediol (BDO) are acceptable. When such isocyanate terminated urethane prepolymers are used, the unreacted isocyanate (NCO) concentration is preferably 4 to 10 wt % (more preferably 4 to 10 wt %, most preferably 5 to 10 wt %). Examples of commercially available isocyanate terminated urethane prepolymers in this category include Imuthane® prepolymers (available from COIM USA, Inc. such as 27-85A, 27-90A, 27-95A); Andur® prepolymers (available from Anderson Development Company, such as, IE75AP, IE80AP, IE 85AP, IE90AP, IE95AP, IE98AP); and Vibrathane® prepolymers (available from Chemtura, such as, B625, B635, B821).

The sub-pad 102 can comprise a polymeric material. The sub-pad material can be more compliant (or more elastic) than the polishing material. The sub-pad 102 can comprise a porous layer. Examples of polymeric materials for the sub-pad layer(s) include polyurethanes, polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyether sulfones, polyamides, polyether imides, polyketones, silicones, copolymers thereof (such as, polyether-polyester copolymers), and combinations or blends thereof.

Polishing pads as disclosed herein can be prepared via a variety of processes, including insertion of a discrete window assembly into a pad having a matching opening, addition of the lower window component to a pad that already has a cast in place upper window component in the upper pad layer, or insertion of the window assembly into a net shape mold used to prepare a top pad layer blank followed by lamination of the sub-pad and application of the optional pressure sensitive adhesive 106.

For example, a plug comprising a material of a top portion on the window can placed in a mold and polishing material molded into a block or cake around the plug. The block or cake can then be sliced into layers having the desired thickness of the polishing layer. A bottom portion of the window can be applied to a surface of the top portion of the window. For example, a pre-formed bottom portion could be adhered or a bottom portion could be cast or molded. The sub-pad can be laminated or cast onto a bottom surface of the polishing layer.

A window assembly having a top portion and bottom portion as described herein can be placed in a mold and the polishing layer formed around the relevant portions. The sub-pad can then be applied by lamination.

As another example a polishing pad as disclosed here can be made by providing a window assembly in a mold with a recess in the mold to hold at least part of the bottom portion of the window and molding the polishing layer around the portion of the window protruding into the mold cavity. This forms a polishing layer with an embedded plug where a portion of the plug protrudes beyond the polishing layer. To form the sub-pad portion of the pad, the sub-pad can be molded in a second molding step in a separate mold provided the mold includes a spacer to provide for the gap.

Where desired a recess of the window region 113 is cut into the top surface of the pad. The polishing layer 101 can also be cut to provide the macrotexture 112. Cutting to form the recess can be done, for example, by milling. A commercially available example of a mill that could be used can be by a CNC mill.

A method of using the polishing pad as disclosed herein comprises providing a substrate to be polished, providing the polishing pad as disclosed herein, optionally providing a slurry on the polishing pad, contacting the polishing pad to the substrate and moving the substrate and the polishing pad relative to each other (e.g., in a rotational movement), and transmitting a signal wave through the window and detecting the signal wave reflected from the substrate back through the window to determine when polishing is complete. When an optical detection is used, use of a semi-transparent slurry is preferred.

This disclosure further encompasses the following aspects.

Aspect 1: A polishing pad for chemical mechanical polishing of a substrate (e.g., a semiconductor wafer) comprising a polishing layer having a top polishing surface and comprising a polishing material, a sub-pad layer comprising a sub-pad material wherein the sub-pad layer is located opposite from the top polishing surface, the sub-pad layer having a bottom sub-pad surface defining a bottom surface of the pad, and a window extending through the polishing pad for transmitting a signal wave through the polishing pad, wherein the window has a top portion that forms a seal with the polishing layer, the top portion comprising a first window material, and a bottom portion that extends from an interface with the top portion of the window toward, preferably to, the bottom surface of the pad and that comprises an elastomeric material wherein there is a gap between side edges of the bottom portion and the sub-pad material.

Aspect 2: The polishing pad of Aspect 1 wherein a portion of the polishing layer in contact with the side edges of the top portion of the window forms a peripheral region that is recessed from the top polishing surface.

Aspect 3: The polishing pad of Aspects 1 or 2 wherein the bottom portion of the window has dimensions in a plane parallel to the top polishing surface and the gap has a dimension of 2 to 10, preferably 3 to 8, and more preferably 4 to 6% of the dimensions of the dimensions of the bottom portion of the window in the plane parallel to the top polishing surface.

Aspect 4: The polishing pad of any of the previous Aspects wherein the gap has dimensions of from 0.1 to 2, preferably 0.2 to 1.8, more preferably 0.3 to 1.6, yet more preferably 0.3 to 1.4, still more preferably 0.4 to 1.2, and most preferably 0.5 to 1 mm.

Aspect 5: The polishing pad of any of the previous Aspects wherein the interface of the bottom portion with the top portion is above a plane defined by a bottom edge of the polishing layer.

Aspect 6: The polishing pad of any of Aspects 1 to 4 wherein the interface of the bottom portion with the top portion is coplanar with a plane defined by a bottom edge of the polishing layer.

Aspect 7: The polishing pad of any of the previous Aspects wherein the elastomeric material is selected from polyurethanes, polyolefins, polyamides, polyacrylates, styrenic block copolymers, and silicone elastomers, preferably silicone elastomers.

Aspect 8: The polishing pad of any of the previous Aspects wherein the polishing layer comprises a polymer matrix with closed cell porosity.

Aspect 9: The polishing pad of any of the previous Aspects wherein the top portion and the bottom portion are optically transparent.

Aspect 10: The polishing pad of any of the previous Aspects further comprising a pressure sensitive adhesion on the bottom surface of the pad.

Aspect 11: The polishing pad of any of the previous Aspects further comprising a further comprising a non-adhesive encapsulating layer in contact with a bottom surface of the bottom portion of the window.

Aspect 12: The polishing pad of any of the previous Aspects wherein the bottom surface of the bottom portion of the window contacts an encapsulating layer that has an exterior surface co-planar with the bottom sub-pad surface.

Aspect 13: The polishing pad of Aspect 11 wherein the encapsulating layer contacts interior edges of the sub-pad layer.

Aspect 14. A method of polishing comprising providing a substrate to be polished providing the polishing pad as in any one of the previous Aspects, providing a between the polishing pad and the substrate, moving the substrate relative to the polishing pad, transmitting a signal wave through the window material and slurry and detecting the signal wave reflected from the substrate back through the window and slurry to determine when polishing is complete.

Aspect 15: The method of Aspect 14 wherein the signal wave comprises a columnated light wave, a non-columnated light wave, or an acoustic wave.

Aspect 16: The method of Aspect 14 wherein the signal wave comprises a columnated light wave or a non-columnated light wave and the top portion and bottom portion are transparent to the respective columnated or non-columnated light wave.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). Moreover, stated upper and lower limits can be combined to form ranges (e.g., "at least 1 or at least 2 weight percent" and "up to 10 or 5 weight percent" can be combined as the ranges "1 to 10 weight percent", or "1 to 5 weight percent" or "2 to 10 weight percent" or "2 to 5 weight percent").

The disclosure may alternately comprise, consist of, or consist essentially of, any appropriate components herein disclosed. The disclosure may additionally, or alternatively, be formulated so as to be devoid, or substantially free, of any components, materials, ingredients, adjuvants or species used in the prior art compositions or that are otherwise not necessary to the achievement of the function or objectives of the present disclosure.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

Unless specified to the contrary herein, all test standards are the most recent standard in effect as of the filing date of this application, or, if priority is claimed, the filing date of the earliest priority application in which the test standard appears.

What is claimed is:

1. A polishing pad for chemical mechanical polishing comprising a polishing layer having a top polishing surface and comprising a polishing material, a sub-pad layer comprising a sub-pad material wherein the sub-pad layer is located opposite from the top polishing surface, the sub-pad layer having a bottom sub-pad surface defining a bottom surface of the pad, and a window extending through the polishing pad for transmitting a signal wave through the polishing pad, wherein the window has a top portion that forms a seal with the polishing layer, the top portion comprising a first window material, and a bottom portion that extends from an interface with the top portion of the window toward the bottom surface of the pad and that comprises an elastomeric material wherein there is a gap between side edges of the bottom portion and the sub-pad material.

2. The polishing pad of claim 1 wherein a portion of the polishing layer in contact with the side edges of the top portion of the window forms a peripheral region that is recessed from the top polishing surface.

3. The polishing pad of claim 1 wherein the bottom portion of the window has dimensions in a plane parallel to the top polishing surface and the gap has a dimension of 4 to 6% of the dimensions of the dimensions of the bottom portion of the window in the plane parallel to the top polishing surface.

4. The polishing pad of claim 1 wherein the interface of the bottom portion with the top portion is coplanar with a bottom edge of the polishing layer.

5. The polishing pad of claim 1 wherein the interface of the bottom portion with the top portion is above a plane defined by a bottom edge of the polishing layer.

6. The polishing pad of claim 1 wherein the elastomeric material is selected from polyurethanes, polyolefins, polyamides, poly acrylates, styrenic block copolymers, and silicone elastomers.

7. The polishing pad of claim 1 wherein the polishing layer comprises a polymer matrix with closed cell porosity.

8. The polishing pad of claim 1 wherein the top portion and the bottom portion are optically transparent.

9. The polishing pad of claim 1 wherein the bottom surface of the bottom portion of the window contacts an encapsulating layer that has an exterior surface co-planar with the bottom sub-pad surface.

10. The polishing pad of claim 9 wherein the encapsulating layer contacts interior edges of the sub-pad layer.

* * * * *